US007347282B2

(12) United States Patent
Betts et al.

(10) Patent No.: US 7,347,282 B2
(45) Date of Patent: Mar. 25, 2008

(54) STEERABLE SOIL PENETRATION SYSTEM

(75) Inventors: Michael John Betts, Rijswijk (NL); Josef Guillaume Christoffel Coenen, Rijswijk (NL); Pieter Karel Anton Kapteijn, Rijswijk (NL); Peter Oosterling, Rijswijk (NL); Paul Dirk Schilte, Rijswijk (NL); Pleun Marinus Van Der Sman, Rijswijk (NL); Gustaaf Louis Van Wechem, Reeuwijk (NL)

(73) Assignee: Shell Oil Company, Houston, TX (US)

( * ) Notice: Subject to any disclaimer, the term of this patent is extended or adjusted under 35 U.S.C. 154(b) by 280 days.

(21) Appl. No.: 10/506,829

(22) PCT Filed: Mar. 7, 2003

(86) PCT No.: PCT/EP03/01744

§ 371 (c)(1),
(2), (4) Date: Mar. 30, 2005

(87) PCT Pub. No.: WO03/076760

PCT Pub. Date: Sep. 18, 2003

(65) Prior Publication Data

US 2005/0161261 A1 Jul. 28, 2005

(30) Foreign Application Priority Data

Mar. 8, 2002 (EP) ..... 02075911

(51) Int. Cl.
*E21B 7/04* (2006.01)
*E21B 7/26* (2006.01)

(52) U.S. Cl. ..... 175/61; 175/22; 175/73; 166/77.2

(58) Field of Classification Search ..... 175/19, 175/22, 61, 62, 73, 53, 293, 295; 166/77.2; 405/184
See application file for complete search history.

(56) References Cited

U.S. PATENT DOCUMENTS

| | | | | |
|---|---|---|---|---|
| 3,422,631 | A * | 1/1969 | Silverman | 405/155 |
| 3,465,834 | A * | 9/1969 | Southworth, Jr. | 173/2 |
| 3,797,586 | A * | 3/1974 | Coyne et al. | 173/133 |
| 3,818,996 | A | 6/1974 | McCaleb | 175/57 |
| 4,306,626 | A | 12/1981 | Duke et al. | 175/35 |

(Continued)

FOREIGN PATENT DOCUMENTS

| | | |
|---|---|---|
| EP | 0395167 | 10/1990 |

(Continued)

OTHER PUBLICATIONS

International Search Report dated Sep. 8, 2003.

*Primary Examiner*—Kenneth Thompson

(57) ABSTRACT

A steerable soil penetration system having a steerable penetration head, which compacts and does not cut away the surrounding soil and which is connected to an elongate flexible tubing such that the orientation of the penetration head can be varied relative to the tubing. The elongate tubing and/or a downhole hammer or tractor pushes the penetration head through the subsurface formation. Preferably the tubing is surrounded by a narrow annulus so that buckling of the tubing is inhibited and the tubing protects the pierced hole against caving in. Optionally the tubing is circumferentially expanded after completion of the piercing process thereby increasing the width of the pierced hole and providing a permanent hole lining.

21 Claims, 2 Drawing Sheets

U.S. PATENT DOCUMENTS

| | | | | |
|---|---|---|---|---|
| 4,646,277 | A | 2/1987 | Bridges et al. | 367/191 |
| 4,694,913 | A | 9/1987 | McDonald et al. | 175/61 |
| 4,856,600 | A | 8/1989 | Baker et al. | 175/26 |
| 4,945,999 | A | 8/1990 | Malzahn | 175/19 |
| 4,955,439 | A | 9/1990 | Kinnan | 175/45 |
| 4,981,181 | A | 1/1991 | Hesse | 175/19 |
| 5,070,948 | A | 12/1991 | Malzahn et al. | 175/19 |
| 5,163,520 | A | 11/1992 | Gibson et al. | 175/19 |
| 5,303,202 | A | 4/1994 | Carroll et al. | 367/13 |
| 5,322,391 | A | 6/1994 | Fisk | 174/73 |
| 5,339,911 | A * | 8/1994 | Whited et al. | 175/62 |
| 5,850,884 | A | 12/1998 | Rodger et al. | 173/91 |
| 5,878,825 | A | 3/1999 | Okuyama et al. | 175/61 |
| 5,904,444 | A | 5/1999 | Kabeuchi et al. | 405/184 |
| 2001/0023614 | A1 | 9/2001 | Tubel et al. | 73/152.39 |
| 2002/0000332 | A1 | 1/2002 | Merecka et al. | 175/73 |

FOREIGN PATENT DOCUMENTS

| | | |
|---|---|---|
| EP | 0806543 | 11/1997 |
| WO | 91/11646 | 8/1991 |
| WO | 00/46484 | 8/2000 |
| WO | 01/75263 | 10/2001 |

* cited by examiner

STEERABLE SOIL PENETRATION SYSTEM

FIELD OF THE IVENTION

The invention relates to a steerable soil penetration system and method.

BACKGROUND OF THE INVENTION

Such a system is known from U.S. Pat. No. 5,163,520. In the known system a steerable penetration head is pivotally connected to a string of tubulars that are interconnected by screw thread connectors and that are pushed in a substantially horizontal direction through a shallow subsurface soil layer by a hydraulic ram, which is mounted in a trench or pit. The ram pushes the tubing string and associated penetration head through the soil and when the last tubing section has been substantially inserted into the created hole the ram is pulled back whereupon a new tubing section is added to the tubular string which is then pushed into the hole, which sequence of adding a new tubing section to the string and inserting it into the hole is continued until the penetration head has reached its target.

US patent specification 2002/0000332, U.S. Pat. No. 4,856,600 and European patent application No. 0395167 disclose steerable rotary drilling systems which produce a large amount of drill cuttings. U.S. Pat. No. 5,850,884 discloses a moling apparatus which is not steerable. U.S. Pat. No. 4,955,439 discloses a steerable fluid jet drilling apparatus which will in use produce a large volume of fluidised drill cuttings.

Other steerable soil penetration systems are known from U.S. Pat. Nos. 4,694,913; 5,070,948; 4,945,999; 4,306,626; 5,904,444; 5,878,825 and 4,981,181.

The aforementioned U.S. Pat. No. 5,878,825 discloses a steerable penetration head, which is rotatably connected to a chain of short and rigid tubular elements that are interconnected by joints that are rotatable about a single axis. The chain of rigid tubular elements is pushed into the hole pierced by the steerable penetration head by an injector formed by a hydraulic piston assembly at the bottom of an injector pitch.

Disadvantages of this known steerable soil penetration system are that the chain of rigid tubular elements interconnected by joints is complex, wear-prone, expensive and prone to buckling into a zig-zag configuration within the pierced hole, thereby significantly increasing the wall friction and inhibiting the penetration process. In addition, it requires a trench or pit.

SUMMARY OF THE INVENTION

In accordance with the present invention there is provided a steerable soil penetration system comprising a steerable penetration head which is connected to an elongate flexible tubing such that the orientation of the penetration head can be varied relative to the tubing and means for injecting the elongate flexible tubing into the hole pierced by the penetration head and for inducing the penetration head to extend the hole in a desired direction. The steerable penetration head in the system according to the invention is configured to penetrate the soil without the action of rotating cutters which means that the penetration head does not form a rotary drill bit which cuts away the soil ahead of the bit and which then produces drill cuttings that are to be removed from the borehole via an annulus surrounding the drill string. Since no cuttings are produced by the penetration head in the system according to the invention the annulus between the tubular string and borehole wall can be narrow, which is of benefit to the accuracy in which the system is steerable.

Preferably the means for injecting the tubing into the pierced hole comprises a tubing injector assembly, which pushes the tubing into the pierced hole to provide thrust to the penetration head. In order to avoid buckling of the elongate flexible tubing when it pushes the penetration head forward the tubing preferably has an outer diameter, which is more than 80%, and more preferably more than 90%, of the largest outer width of the steerable penetration head.

In one embodiment the flexible tubing is provided with conduits and/or electric cables for supplying power to the steerable penetration head. Alternatively or additionally, the flexible tubing can be equipped with electrical cables or optical fibres for data communication to and from the steerable penetration head. Suitably, said conduits, cables and fibres can be embedded in the wall of the flexible tubing. A suitable composite flexible tubing with electrical power cables embedded in the wall is disclosed in International patent application WO 0175263. Alternatively the flexible tubing may be a coilable steel tubing which may consist of a pair of coaxial steel tubulars wherein the electrical or other power and or transmission cables extend through the annular space between the inner and outer tubular.

The elongate flexible tubing surrounded by a narrow annulus also serves as a hole lining which protects the hole against caving-in throughout and optionally also after completion of the hole piercing process. Optionally the elongate flexible tubing remains in the pierced hole to serve as a permanent hole lining and may be circumferentially expanded by inflation and/or an expansion device such as a mandrel or tractor to increase the internal width of the hole lining and optionally of the hole itself. The elongate flexible tubing may be equipped with a staggered pattern of relatively weak spots and/or openings, which break open and/or widen up to reduce the forces required to circumferentially expand the tubing wall. Suitably, the elongate flexible tubing is a steel tubular in which a staggered array of longitudinal slots is present, which slots traverse at least part of the wall in a radial direction. The slots may be filled with an elastomeric or other plugging agent which remains intact when the hole is being pierced, which agent is configured to break, rip, dissolve or otherwise losses its sealing function by e.g. mechanical and/or chemical disintegration when the tubing is circumferentially and/or radially expanded after completion of the piercing process.

The steerable penetration head and/or flexible tubing may be provided with one or more repetitive shock generating, vibration and/or pulsating devices for enhancing the penetration rate of the penetration head through the soil in particular during a final phase of the hole piercing process. Also a vibration and/or shock generating device can be provided to reduce friction of the flexible tubing in the hole. Both these devices can be powered through said conduits or cables.

Preferably the steerable penetration head comprises a sensor for detecting obstacles ahead of the penetration head, which sensor is connected to a steering mechanism that is capable of changing the orientation of the penetration head relative to the tubing such that the penetration head follows a curved trajectory to avoid detected obstacles. The steering mechanism preferably allows to steer the penetration head along a predetermined trajectory through the soil and to return to said predetermined trajectory after the penetration head has deviated form said trajectory to avoid a detected obstacle.

The steerable penetration head may comprise a sensor and a real time positioning device for detecting the position of the head relative to a known fixed point. The steering system and the positioning system may interact and make it possible to follow the preset trajectory.

Suitably, the steerable penetration head comprises a tapered nose section having a central axis that can be pivoted in any direction relative to a longitudinal axis of the tubing by the steering mechanism. To this end the tapered nose section may be connected to the tubing by a bendable tubular steering section, which can be induced by the steering mechanism to alternatingly obtain a straight or a curved shape. Said bendable tubular steering section may comprise memory metal, bimetallic, or technical ceramic (PZT) components which deform in response to temperature variations or to electrical voltage and one or more heating elements or electrical sources that are configured to vary the temperature or voltage of said components such that the bendable tubular section either obtains a straight or a curved shape.

The bendable tubular steering section may either bend proportional or in an on/off non-proportional mode. In a suitable embodiment the bendable tubular steering section comprises at least three circumferentially spaced segments that are individually heated or cooled such that the lengths of the segments will vary and that the bendable tubular section either obtains a straight or a curved shape. Alternatively, the bendable tubular steering section is at one side weakened by perforations, slits or otherwise such that it will bend in a predetermined direction under the axial compression force exerted by the elongate flexible tubing and a stiff sleeve is movably arranged adjacent to the bendable tubular section such that the sleeve can be moved within or around the bendable tubular section to force the section into a substantially straight position and which can be retrieved from the bendable tubular to induce the bendable tubular section to bend under the axial compression force exerted by the elongate flexible tubing.

In yet another embodiment of the system according to the invention the steerable penetration head may comprise a nose section which holds jetting nozzles which are geared to produce a hole in soft soil, hard soil and rock through which the elongated flexible tube is pushed in. The jetting devices can be actuated independently and produce enough radial trust to bend the head assembly in the desired direction. In this embodiment the elongated flexible tube will also hold tubes through which jetting fluids is moved to the penetration head and the jetting nozzles and cables for controlling the nozzles.

The method according to the invention for piercing an at least partially horizontal hole in a subsurface formation with a steerable soil penetration system comprises the step of exerting a thrust force to a steerable penetration head which compacts the surrounding soil substantially in the absence of rotating cutters by an elongate flexible tubing and/or downhole propulsion means thereby inducing the penetration head to extend the hole in a desired direction.

Optionally, at least part of the elongate flexible tubing is left behind in the pierced hole to serve as a permanent hole liner and at least part of the elongate flexible tubing may be circumferentially expanded after completion of the piercing process such that the expanding tubing radially expands the pierced hole to a larger internal width. The expansion process may create a predetermined pattern or track in the permanent hole liner, which could be used by the expansion device or tractor to propel itself forward.

In some embodiments of the present invention includes a system and method for creating a hole in a subsurface formation, wherein a small diameter pilot hole is pierced into the formation which pilot hole is subsequently expanded to an encased larger diameter hole in which one or more fibre optical, electrical and/or other cables and/or fluid transportation conduits are inserted, or which hole may serve as a subsurface fluid transportation and/or drainage conduit.

In some embodiments of the present invention includes is to provide a cost effective system and method for creating a grid of shallow holes in a subsurface formation in urban and other areas, in which holes strings of aeophones and/or fibre optical sensing devices can be permanently inserted for monitoring seismic reflections and/or other geophysical effects during an extensive period of time, with a minimum impact on the environment at the earth surface.

In some embodiments of the present invention includes is to provide a system and a method for creating a hole in a subsurface formation to accommodate transmission systems such as tubes, pipes, hoses, cables, rods and bars or hole preservation systems such as conduits, ducts and casings or which can be used as a pilot or guidance hole for reaming or otherwise enlaraing the hole.

BRIEF DESCRIPTION OF THE DRAWING

The foregoing and other features, objects, applications and effects of the method and system according to the invention will become more apparent from the following more detailed description of preferred embodiments of the invention in which reference is made to the accompanying drawings, in which.

DETAILED DESCRIPTION OF THE INVENTION

Figure 1:
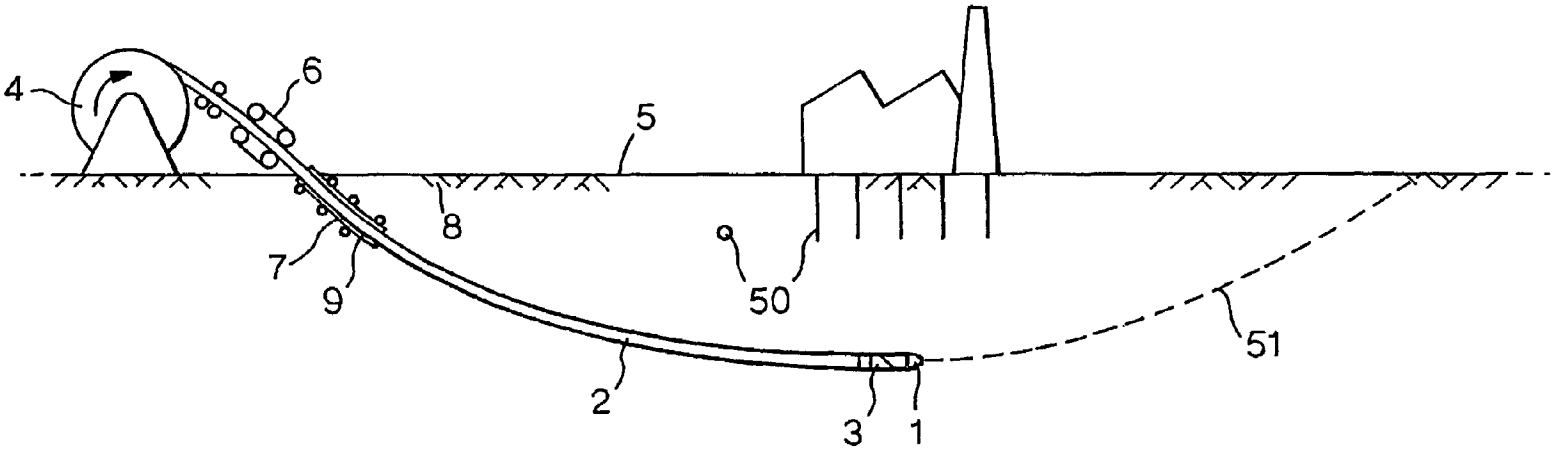
FIG. 1 is schematic longitudinal sectional view of a shallow hole, which is being pierced into a subsurface formation by a steerable hole penetration system according to the invention.

Referring now to FIG. 1, there is shown a steerable hole penetration system comprising a steerable penetration head 1, which is rotatably and pivotably connected to an elongate flexible tubing 2 by a steering mechanism 3. The tubing 2 is unreeled from a reeling drum 4 at the earth surface and pushed into the hole pierced by the penetration head 1 by a tubing injector assembly 6. Adjacent to the tubing injector assembly 6 a tubing guide pipe 7 is screwed in an inclined position into the topsoil. Alternatively said guide pipe 7 may be hammered or drilled into the topsoil. The guide pipe 7 safeguards a stable and pressure tight launch pad for the flexible tubing 2 into the hole. After the soil has been removed from the interior of the tubing guide pipe 7 a wedge 9 is inserted near the bottom of said interior and the penetration head 1 is pushed into the underlying earth formation 8 by the thrust exerted by the tubing injector assembly 6 via the tubing 2 to the penetration head 1.

The steering mechanism 3 is configured to orient the penetration head 1 either in a substantially aligned or in a slightly misaligned direction relative to the elongate flexible tube 2 in which case either substantially straight or slightly curved hole sections will be pierced.

Figure 3:
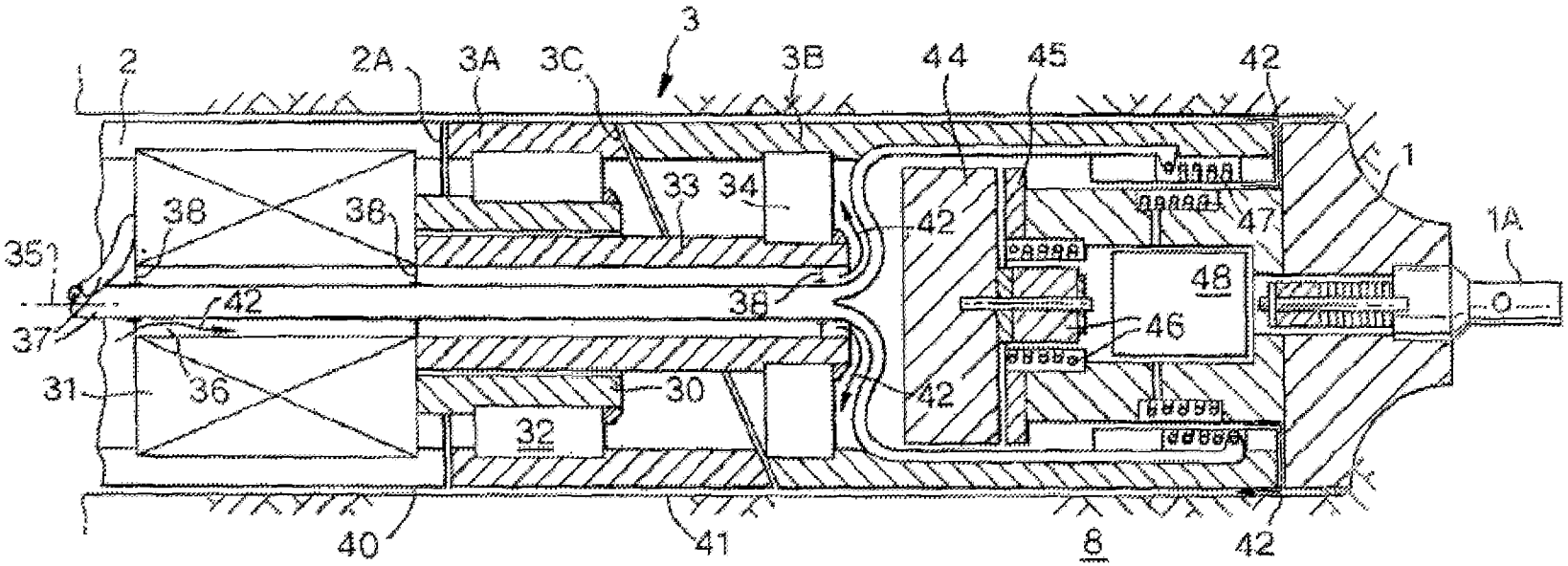
FIG. 3 is a more detailed longitudinal sectional view of the penetration head of the steerable hole penetration system shown in FIG. 1.

FIG. 3 shows in more detail the penetration head 1 and steering mechanism 3 of the steerable hole penetration system of FIG. 1.

The steering mechanism 3 comprises a first tubular section 3A which is rotatably connected to a proximal end 2A of the elongate tubing 2 by a first hollow shaft 30 which is at one end connected to a first electrical motor and gear mechanism (not shown) inside the orientation control unit 31 and at another end to the first tubular section 3A by means of a series of radial spacers 32. The steering mechanism 3 furthermore comprises a second tubular section 3B which is rotatably connected to a slant proximal end 3C of the first tubular section 3A by a second hollow shaft 33 which co-axially surrounds the first hollow shaft 30 and which is at one end connected to a second electrical motor and gear mechanism (not shown) inside the orientation control unit 31 and at another end to the second tubular section 3B by means of a series of radial spacers 34.

Rotation of the second tubular section 3B relative to the first tubular section 3A of the steering mechanism 3 will as a result of the slant orientation of the proximal end 3C cause the penetration head 1 to obtain a slightly deviated orientation relative to the central axis 35 of the elongate flexible tubing 2 in which case a slightly curved hole section is pierced. The angular orientation of the curved hole section relative to the central axis 35 is simultaneously controlled by rotating the first tubular section 3A relative to the proximal end 2A of the elongate flexible tubing 2. The steering mechanism 3 may be made of a composite shock absorbing material and/or comprise one or more shock absorbers (not shown).

Inside the first hollow shaft 30 and the orientation control unit 31 a central opening 36 is present in which an umbilical electrical cable bundle 37 is secured by means of a series of spacers 38. The central opening 35 also serves as a fluid injection conduit through which a lubricating and cooling liquid is injected into an annular space 40 between the elongate tubing 2 and the inner wall 41 of the pierced hole as illustrated by arrows 42. Preferably said liquid is injected at low speed into the annular space 40 in order to inhibit creation of wash outs of the pierced hole by jetting action.

The penetration head 1 is at least during an initial stage of the piercing process pushed forward through the subsurface formation 8 by the thrust exerted by the tubing 2, thereby compacting and/or pushing aside the formation in the immediate vicinity of the penetration head 1. When a substantial length of tubing 2 has been injected into the hole, friction between the tubing 2 and the inner surface 41 of the hole will reduce the thrust exerted to the penetration head 1. To stimulate the progress of the penetration process the penetration head 1 is vibrated in an axial and/or radial direction relative to the tubing 2 and steering mechanism 3 by means of a hammer 44 and anvil 45 assembly which are vibrated relative to the second tubular section 3B and relative to each other by means of an electromagnetic linear motor 46 and which receives electric power from the electric power cable bundle 37 via a inductive coupling 47. The inductive coupling 47 also provides electric power to an electronic sensing and control unit 48 which senses acoustic reflections of the impacts exerted by the penetration head 1 to the formation 8 in order to identify any obstacles within the formation 8 ahead of the penetration head 1. The inductive coupling 47 and electrical umbilical cable bundle 37 serves as bi-directional power and signal transmission umbilical between an electrical power and control unit (not shown) at the earth surface and the downhole electronic sensing and control unit 48 within the penetration head 1.

In the embodiment shown in FIGS. 1 and 3 the penetration head 1 comprises a tapered main section in which a cylindrical nose section 1A is inserted such that the penetration head 1 is substantially rotational symmetrical to the central axis 35 of the penetration system. In an alternative embodiment the penetration head 1 may have a frontal surface that permanently has a slant orientation relative the central axis 35 such that the penetration head 1 will create a curved hole in which case the steering mechanism 3 may comprise a single rotatable section 3A only, or comprise an array of three circumferentially spaced, for example a bi-metallic, memory or electrically activated metal, or voltage responsive PZT ceramic segments (not shown) which may individually contract away from or expand against the inner wall 41 to steer the penetration head 1 such that it follows a predetermined trajectory or circumvents any subsurface obstacles 50 detected by the downhole sensing and control unit 48 and subsequently returns to said predetermined course as indicated by the dotted line 51 in FIG. 1. Alternatively the steering system may comprise a set of three hybrid bi-metallic and hydraulic assemblies that are known as smart rams.

Figure 2:
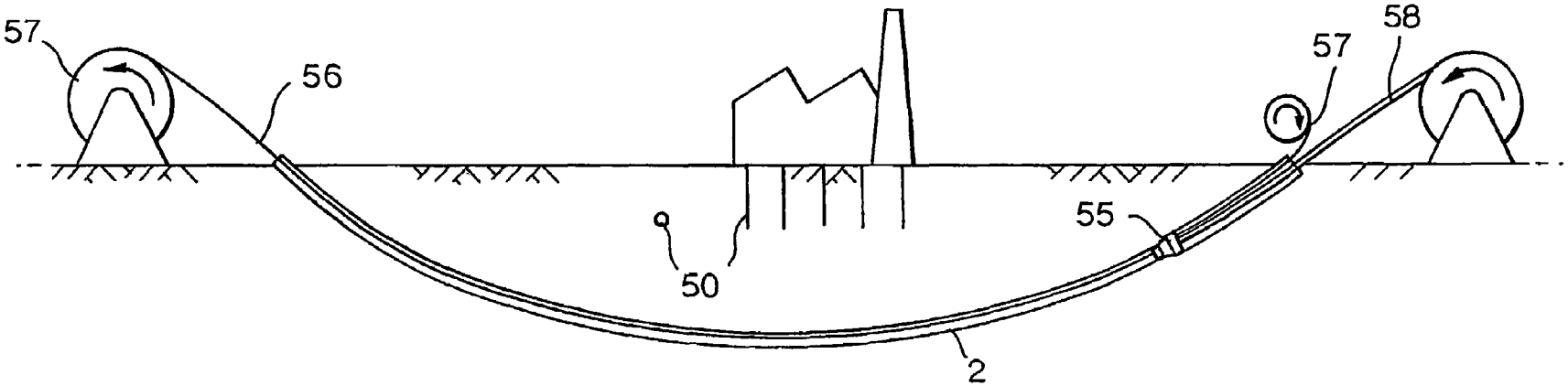
FIG. 2 is a schematic longitudinal sectional view of the thus pierced hole in which an elongate flexible tubing is circumferentially expanded to increase the internal width of the hole.

FIG. 2. shows how after completion of the piercing process the elongate flexible tubing 2 is circumferentially expanded by an expansion device 55, which is pulled through the tubing 2 by winding a cable 56 around a drum 57. An electrical cable 59 and a flexible fluid transportation conduit 58 are simultaneously pulled into the expanded tubing 2 by the expansion device 55. The expansion device 55 may comprise an expansion mandrel and/or rollers and a traction unit (not shown), which propels the device 55 forward through the tubing 2. The tubing may comprise a staggered array of weak spots, which open up or expand during the expansion process. The traction unit may comprise spikes, which penetrate through the thus created openings to generate a sufficient thrust to the expansion device 55 such that the tubing is expanded and the borehole width is simultaneously increased by the expanding tubing 2.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A steerable soil penetration system, the system comprising:

a steerable penetration head configured to penetrate the soil by compacting the soil without the action of rotating cutters;

an elongate flexible tubing connected to the steerable penetration head such that the orientation of the penetration head can be varied relative to the tubing; and a tubing injector assembly effective to inject the elongate flexible tubing into the hole pierced by the penetration head and to induce the penetration head to pierce the hole in a desired direction;

wherein the steerable penetration head is provided with a repetitive shock generating device for enhancing the penetration of the penetration head through the soil, which device is configured to vibrate the penetration head in axial and radial directions in order to reduce friction and compact surrounding soil.

2. The steerable soil penetration system of claim 1, wherein the tubing injector assembly pushes the tubing into the pierced hole thereby providing thrust to the penetration head, and wherein the tubing has an outer diameter which is more than 80% of the largest outer width of the steerable penetration head.

3. The steerable soil penetration system of claim 1, wherein a system lubricating fluid is injected through the interior of the tubing and an annular space between the tubing and the surrounding soil.

4. The steerable soil penetration system of claim 1, wherein the tubing is provided with conduits, electrical cables or optical fibres for the supply of power or for data communication or for measuring stresses along at least a substantial part of the length of the tubing.

5. The steerable soil penetration system of claim 1, wherein the repetitive shock generating device is actuated by an electrical actuator which is connected to an electrical source via an electrical conductor which extends through the interior or the wall of the tubing.

6. The steerable soil penetration system of claim 1, wherein the steerable penetration head comprises a sensor for detecting obstacles ahead of the penetration head which sensor is connected to a steering mechanism which is configured to change the orientation of the penetration head relative to the tubing such that the penetration head follows a curved trajectory to avoid detected obstacles.

7. The steerable soil penetration system of claim 6, wherein the steering mechanism is programmed to steer the penetration head along a predetermined trajectory through the soil and to return to said predetermined trajectory after the penetration head has deviated form said trajectory to avoid a detected obstacle.

8. The steerable soil penetration system of claim 1, wherein the steerable penetration head comprises a tapered nose section having a central axis that can be pivoted in any direction relative to a longitudinal axis of the tubing by the steering mechanism.

9. The steerable soil penetration system of claim 1, wherein the penetration head is connected to the tubing by a bendable tubular steering section which can be induced by the steering mechanism to alternatingly obtain a straight or a curved shape.

10. The steerable soil penetration system of claim 9, wherein the bendable tubular steering section comprises memory metal or bimetallic components and one or more heating elements that are configured to vary the temperature of said components such that the bendable tubular section either obtains a straight or a curved shape.

11. The steerable soil penetration system of claim 9, wherein the bendable tubular steering section comprises at least three circumferentially spaced segments, which segments can be individually heated or cooled such that the lengths of the segments will vary and that the bendable tubular section either obtains a straight shape or becomes curved in any predetermined orientation.

12. The steerable soil penetration system of claim 9, wherein the bendable tubular steering section is at one side weakened by perforations, slits or otherwise such that it will bend in a predetermined direction under the axial compression force exerted by the elongate flexible tubing and wherein a stiff sleeve is movably arranged adjacent to the bendable tubular section such that the sleeve can be moved within or around the bendable tubular section to force the section into a substantially straight position and which can be retrieved from the bendable tubular to induce the bendable tubular section to bend under the axial compression force exerted by the elongate flexible tubing.

13. The steerable soil penetration system of claim 1, wherein at least a substantial part of the elongate flexible tubing is configured to be circumferentially expanded after completion of the hole penetration process.

14. The steerable soil penetration system of claim 13, wherein the elongate flexible tubing is equipped with a staggered pattern of relatively weak wall segments that are configured to widen or open up during the circumferential expansion process, thereby reducing the forces required to circumferentially expand the tubing.

15. A method of piercing an at least partially horizontal or inclined hole in a subsurface formation with a steerable soil penetration system comprising a steerable penetration head, wherein a thrust force is exerted to the steerable penetration head by an elongate flexible tubing or downhole propulsion means, thereby inducing the penetration head to pierce the hole in a desired direction; wherein the penetration head is configured to compact soil adjacent to the penetration head substantially without the action of rotating cutters; wherein at least part of said thrust force is applied to the steerable penetration head by a downhole propulsion means which comprises a downhole shock generator which hammers the penetration head forward through the subsurface formation during at least a final part of the hole piercing process, and wherein the downhole shock generator is configured to vibrate the penetration head in axial and radial directions.

16. A method of piercing an at least partially horizontal or inclined hole in a subsurface formation with a steerable soil penetration system comprising a steerable penetration head, wherein a thrust force is exerted to the steerable penetration head by an elongate flexible tubing or downhole propulsion means, thereby inducing the penetration head to pierce the hole in a desired direction; wherein the penetration head is configured to compact soil adiacent to the penetration head substantially without the action of rotating cutters, wherein at least part of said thrust force is applied to the steerable penetration head by a downhole propulsion means which comprises a downhole shock generator which hammers the penetration head forward through the subsurface formation during at least a final part of the hole piercing process; wherein at least part of said thrust force is exerted on the penetration head by pushing the elongate flexible tubing into the pierced hole and the tubing has an outer diameter which is more than 80% of the largest outer width of the steerable penetration head and/or of the hole being pierced thereby.

17. The method of claim 16, whereby an electrical voltage is applied between the flexible tubing and the hole in such a way that polarization of any clay particles in the wall of the hole reduces any tubing-to-wall sticking tendency and decreases tubing-to-wall friction.

18. The method of claim 16, wherein at least part of the elongate flexible tubing is left behind in the pierced hole to serve a hole liner.

19. The method of claim 18, wherein at least part of the elongate flexible tubing is circumferentially expanded after completion of the piercing process such that the expanding tubing radially expands the pierced hole to a larger internal width.

20. The method of claim 19, wherein at least part of the elongate flexible tubing is circumferentially expanded by an expansion device which comprises an expansion cone and/or rollers that increase the internal width of the tubing when the device is moved in a longitudinal direction through the tubing and which expansion device simultaneously pulls one or more electric, fibre optical, fluid transportation and/or other conduits into the expanded section of the hole.

21. The method of claim 16, wherein a string of geophones and/or fibre optical sensing devices is inserted into the pierced hole to monitor seismic reflections and/or other geophysical effects during an extensive period of time.

* * * * *